United States Patent [19]

Narozny

[11] 3,964,816

[45] June 22, 1976

[54] ELECTRICAL CONTACT

[75] Inventor: Ronald S. Narozny, Panorama City, Calif.

[73] Assignee: Thomas & Betts Corporation, Elizabeth, N.J.

[22] Filed: Aug. 22, 1974

[21] Appl. No.: 499,588

[52] U.S. Cl. ..... 339/99 R; 339/221 M; 339/276 A

[51] Int. Cl.[2] ..... H01R 13/38

[58] Field of Search ..... 339/95, 97–99, 339/220, 221, 276 A

[56] References Cited

UNITED STATES PATENTS

| | | | |
|---|---|---|---|
| 2,518,489 | 8/1950 | Orlando | 339/97 R |
| 2,870,241 | 1/1959 | Mason | 339/276 A |
| 3,273,103 | 9/1966 | Ericson | 339/22 B |
| 3,355,699 | 11/1967 | Oshva | 339/99 R |
| 3,403,372 | 9/1968 | Stinson, Jr. | 339/97 R |
| 3,543,226 | 11/1970 | Laboue | 339/221 M |
| 3,805,214 | 4/1974 | Demler, Sr. et al. | 339/97 R |
| 3,820,055 | 6/1974 | Huffnagle et al. | 339/97 P |
| 3,820,058 | 6/1974 | Friend | 339/99 R |
| 3,860,318 | 1/1975 | Reavis, Jr. et al. | 339/99 R |

FOREIGN PATENTS OR APPLICATIONS

| | | | |
|---|---|---|---|
| 479,961 | 11/1969 | Switzerland | 339/97 R |

OTHER PUBLICATIONS

Ansley Blue Streak Cable Connector System, 7–1974, 2 pp.

*Primary Examiner*—Joseph H. McGlynn
*Attorney, Agent, or Firm*—David Teschner; Jesse Woldman

[57] ABSTRACT

An electrical contact for joining the conductor of an insulated cable to a further electrical terminal point such as a DIP plug, a printed circuit board card, a flat cable, etc. The upper portion is formed in a cylindrical configuration with two upstanding arms spaced apart at two colinear points on their circumference to provide an insulation piercing slot and a strain relief slot. The free ends of the upstanding arms are pointed to permit the contact to pierce the insulation about a conductor and allow one slot to make a good electrical joint with the conductor itself while the other slot grips the conductor insulation to provide strain relief. A properly configured tail portion permits the connector to be appropriately coupled to a terminal point.

12 Claims, 15 Drawing Figures

ELECTRICAL CONTACT

BACKGROUND OF THE INVENTION

1. Field of the Invention

The invention is directed to the field of insulation piercing contacts for use with flat cable and which permits the conductors of such flat cable to be coupled to other electrical terminal points.

2. Description of the Prior Art

Prior art devices for piercing through the insulation of insulated conductors usually consisted of a contact member fabricated from a flat piece of material, punched or stamped so as to provide a contact with two arms and a tail portion. The arms, each terminating in a pointed free end, defined an insulation piercing slot therebetween. To maintain the greatest degree of flexibility, to permit reuse and to provide for a range of conductor sizes which the contact could handle, thin metal stock was generally employed. This flexibility of the contact, at times, led to its excess deflection and distortion during insulation piercing with a resultant poor contact with the conductor. Also, the sharp ends of the contact breached the insulation but did not tear it so as to permit easy engagement with the contact. With stiff insulation the effect often was the bending of one or both of the contact arms with the attendant lack of electrical contact.

SUMMARY OF THE INVENTION

The present invention seeks to overcome the defects noted above with respect to the prior art by providing a contact which is readily usable with flat cable without prior stripping or preparation, and which can handle a wide range of conductor sizes while providing strain relief for joints made with the novel contact. The contact of the invention has a cylindrical body portion terminating in two upstanding arms defining therebetween two slots. A first of the slots has a width less than the diameter of the conductor itself so that intimate contact can be made between the conductor and the metal of the adjacent arm edges. The second of the slots has a width greater than the diameter of the conductor but less than the outer diameter of the individual portion of the insulated cable. When positioned within this second slot, the insulation is merely entered but not pierced completely through. In this manner, the cable is strain relieved against the effects of longitudinal forces applied to the cable itself. The free ends of the upstanding arms are gently tapered from the slots to an apex therebetween providing a long transistion area permitting the insulation to be cut and stripped away from the conductors as the cable is fed into the contact. This tearing of the insulation in the area of the contact prevents the cold flow of the insulation back to the conductor which could interfere with the electrical joint between conductor and contact. As desired, any one of a number of tail portions can be formed on the opposite end of the contact, for example, a straight, solid tail with sharp corners provides a post for wrapping conductors thereabout, a tail with dimple is used where the connector is to be plugged into a dual-in-line package or DIP plug, a curved tail can also be used if the contact is to be positioned in a socket to contact the contact tail of another contact arranged as a male connector or arranged to engage the conductive pads of a printed circuit board. It is therefore an object of this invention to provide a novel contact.

It is another object of this invention to provide an improved insulation piercing connector contact.

It is yet another object of this invention to provide an improved insulation piercing connector contact which provides strain relief for the contact joint.

It is another object of this invention to provide an improved insulation piercing contact having a cylindrical upper body terminating in insulation piercing arms and having therebetween two slots, one to contact the conductor and another to provide strain relief for such conductor.

Other objects and features of the invention will be pointed out in the following description and claims and illustrated in the accompanying drawings, which disclose, by way of example, the principles of the invention and the best modes which have been contemplated for carrying them out.

BRIEF DESCRIPTION OF THE DRAWINGS

In the drawings in which similar elements are given similar reference characters.

Figure 1:
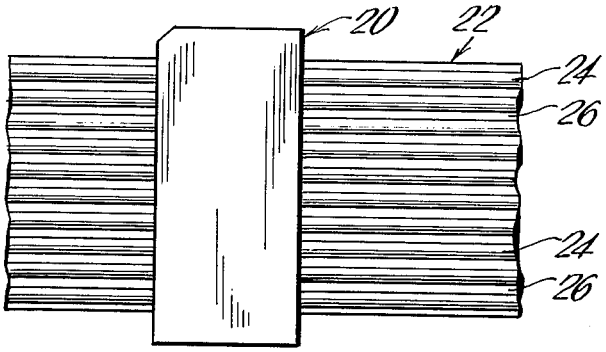
FIG. 1 is a top plan view of a connector shown installed on a flat cable.
Figure 2:
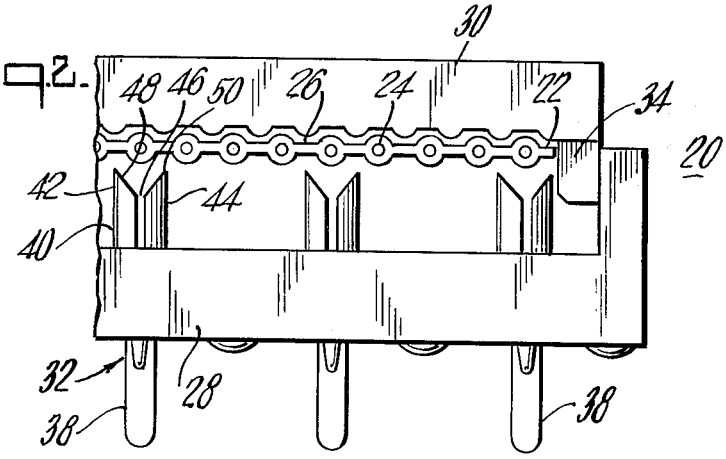
FIG. 2 is a front elevation of the connector of FIG. 1 showing portions of the connector and the flat cable prior to the installation of the connector to the cable, and containing contacts constructed in accordance with the concepts of the invention.
Figure 3:
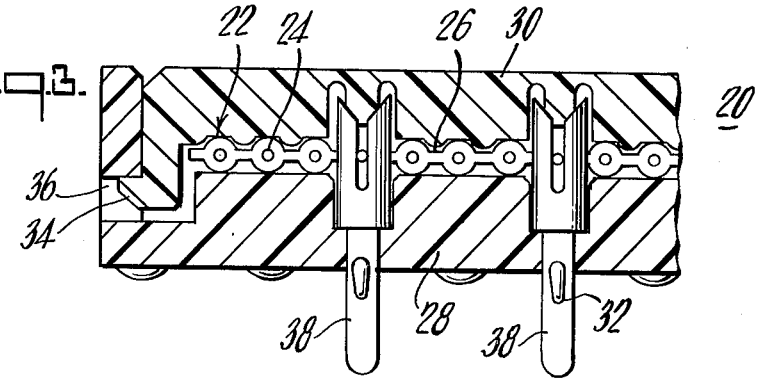
FIG. 3 is a fragmentary, front elevational view, in section, showing the connector of FIG. 1 fully installed to the flat cable.

DESCRIPTION OF THE PREFERRED EMBODIMENTS:

Turning now to FIGS. 1, 2 and 3 there is shown a connector 20 employing a contact constructed in accordance with the concepts of the invention shown installed upon a flat cable 22. Flat cable 22 consists of a number of individual conductors 24 which may have a round, square, rectangular, or other desirable cross section and which are arranged in a supporting insulating media 26. The connector 20, as is better seen in FIG. 2, consists of a base plate 28, a top plate 30, and a series of contacts 32. A latch member 34 is arranged to hold the top plate 30 in intimate contact with the flat cable 22 once the same has been properly positioned within the connector 20. As is best seen in FIG. 3, the latch mechanism 34 is able to engage a recess 36 in the base plate 28 and thus lock the component portions of the connector 20 together. Although only one latch member 34 is visible in FIG. 2, it should be understood that there are two latch members 34, one at each end of top plate 30, which cooperate with an associated recess 36 at each end of bottom plate 28. The individual contacts 32 have a tail portion 38, which, as will be explained later with respect to the individual contacts, may be formed such as to be received within the sockets of a DIP plug, or may have wire wrapped connections made thereabout, or may provide for wave soldering, welding, or other methods of connecting individual contact tails 38 to the remaining portions of the circuit to which they are to be connected.

Figure 4:
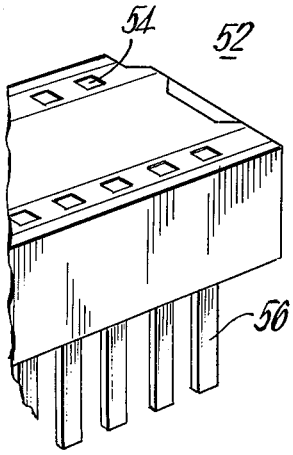
FIG. 4 is a fragmentary perspective view of a DIP plug of the type which can receive the connector of FIG. 1.
Figure 5:
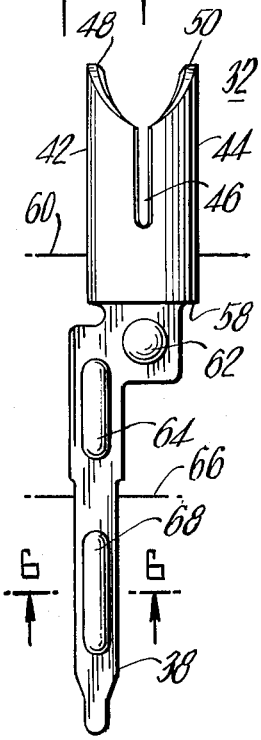
FIG. 5 is a front elevational view of one form of contact constructed in accordance with the concepts of the invention.
Figure 8:
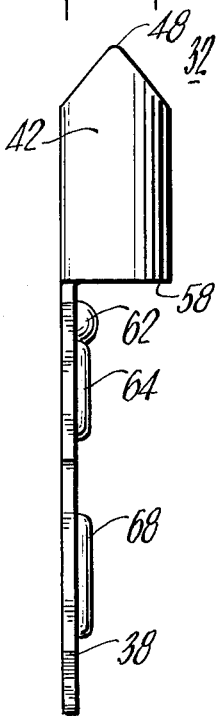
FIG. 8 is a side elevational view of the contact of FIG. 5.
Figure 6:
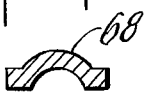
FIG. 6 is a bottom plan view of a portion of the contact of FIG. 5 taken along the lines 6—6 in FIG. 5.
Figure 7:
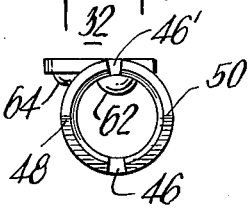
FIG. 7 is a top plan view of the contact of FIG. 5.

The contacts 32 terminate in an upper portion 40 for receipt of the individual conductors 24 of a flat cable 22 therein. The upper portion 40 is constructed of two upstanding arms 42 and 44 which define therebetween two slots 46 and 46'. Only the front slot, or slot 46 is visible in FIG. 2, the second slot 46' only being visible in FIG. 7. Each of the upstanding arms 42 and 44 are sharpened as at 48 and 50, respectively, so that they may pierce the insulation 26 of the cable 22 and assist in positioning the individual conductors 24 within the slots 46, 46' of the contact 32. The interior surfaces of the latch members 34 extend perpendicular to the top plate 30 and define a trough between which the full extent of the flat cable 22 may be received. In this manner, the flat cable 22 is properly aligned with base plate 28 so as to position individual ones of the conductors 24 in alignment with the slots 46, 46' within the contacts 32. Thus, upon the application of force upon the top plate 30, in a direction towards base plate 28, the individual conductors 24 are forced into the slots 46, 46' of the contacts 32. The sharpened edges 48 and 50 of the contacts 32 cause the tearing of the insulation 26 in the areas adjacent the conductors 24. Finally, the tapered surfaces, leading from the sharpened edges 48 and 50, of the contacts 32, guide the individual conductors 24 into the slots 46, 46'. The width of the slot 46 is so chosen that it is slightly less than the diameter of the conductor 24 if the same be round, or slightly less than the flat dimension in parallel with the bottom plate 28 should the individual conductors 24 take on a square, or rectangular configuration. In this manner, it is sure that intimate contact is made between the contact 32 and the bare metal of the conductors 24. As was described above the second slot 46' is not of the same width, and is not able to cut through the insulation and make contact with the bare new metal of the conductor 24 but only engages the insulation about the conductors 24 and acts as a strain relief to prevent undesirable breaking of the conductors 24 should the conductors 24 be flexed with respect to the connector 20. As can be appreciated from FIG. 3, the individual conductors 24 have been caused to enter the slots 46, 46' of the contacts 32 while the cable itself has been carefully gripped between the top plate 30 and the bottom plate 28 providing additional strain relief for the flat cable 22. The tail portions 38 are now available to be inserted within the sockets 54 of a so called DIP socket 52, as shown in FIG. 4. Contact tails 56 of the socket 52 may in turn be welded, or soldered to individual conductors, conductive portions of cable or printed circuit boards, or may have wires installed thereupon by means of wire wrap or other well known techniques.

Turning now to FIGS. 5 through 8, further details of the contact, as shown in FIGS. 2 and 3, can be appreciated. The contact is formed of flat stock having the desired strength and flexibility and has the upper portion 40 rolled in a cylindrical configuration to provide upstanding arms 42 and 44. The upper portions of the upstanding arms 42 and 44 are formed in sharp points as at 48, 50 respectively and the arms 42, 44 are formed into generally arcuate segments, as is clearly visible in FIG. 7. Slots 46 and 46' cut into the cylindrical upper portion 40 of the contact 32 so as to receive the conductors 24 of the flat cable 22. The seaming of the material of which the contact 32 is formed is intermediate the slot 46'. Slot 46', due to the selection of the width thereof as well as due to the natural tendency of the portions of the contact 32 to open along the seam is slightly larger than the conductor 24 in such a manner as to grab the insulation thereabout and act as a strain relief for the junction between the contact 32 and the conductor 24. The slot 46 has a width slightly less than the diameter of the conductor 24 if the conductor 24 is round, and slightly less than the flat width of a square or rectangular conductor so that the insulation is completely parted and contact is made between the defining walls of slot 46 and the conductor 24. The cylindrical upper portion 40 of the contact 32 terminates in a shoulder 58 which will prevent the downward movement of the overall contact 32 when the contact 32 has been positioned within the appropriate aperture within base plate 28 of the connector 20. With proper positioning, the contact 32 will be positioned so that shoulder 58 is some distance below the line 60, in FIG. 5, which represents the upper surface of the base plate 28. Dimples 62 and 64 are provided in the transition region of the contact 32 to provide additional strength and to help prevent withdrawal in an upward direction with respect to FIG. 5 and thus prevent its removal from the base plate 28. The tail portion 38 will extend below the line 66 which represents the bottom surface of the base plate 28 of the connector 20. A further dimple 68 appears in such contact tail portion 38 to insure that good contact is made with the contacts within a socket such as 54 in the DIP socket 52 shown in FIG. 4.

Figure 9:
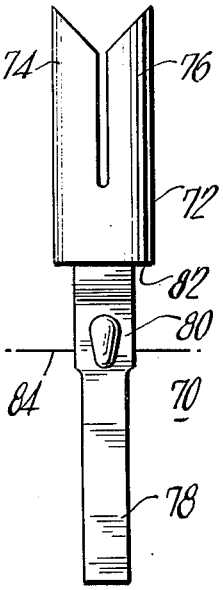
FIG. 9 is a front elevational view of another form of contact constructed in accordance with the concepts of the invention.
Figure 11:
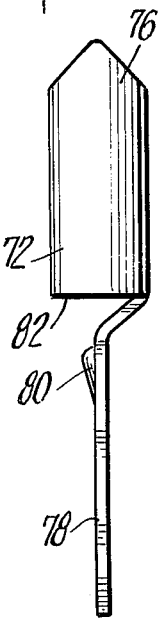
FIG. 11 is a side elevational view of the contact of FIG. 9.
Figure 10:
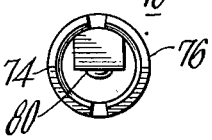
FIG. 10 is a top plan view of the contact of FIG. 9.
Figure 13:
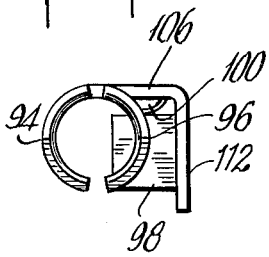
FIG. 13 is a top plan view of the contact of FIG. 12.
Figure 12:
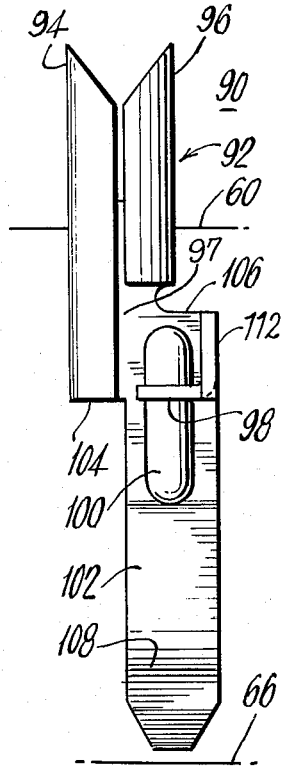
FIG. 12 is a front elevational view of yet another contact constructed in accordance with the concepts of the invention.

Turning now to FIGS. 9 through 11 there is shown a further contact 70, constructed in accordance with the concepts of the invention. As is best seen in FIG. 9 the contact 70 has an upper cylindrical portion 72 composed of upstanding arms 74 and 76 respectively and in all details similar to the cylindrical upper portion 40 of contact 32, described above. The lower portion, including the intermediate or transition portion and contact tail portion 78, have been modifed with respect to that described with reference to FIGS. 5 through 8. Contact 70 is intended to be used where the conductors will be wrapped directly upon the contact tail portions 78 by techniques known as "wire wrapping" or similar techniques. Also, the contact tails 78 are long enough so that conductors can be directly soldered, welded, or otherwise affixed thereto, if desired. An annular shoulder 82, at the bottom of the upper cylindrical portion 72, permits the insertion of the contact 70 within the base plate 28 of the proper type of connector. A single detent 80 is struck from the material of the contact tail 78, and provides the necessary engagement between the contact 70 and the material of the base plate 28 to prevent its withdrawal in an upward direction with respect to FIG. 9. Properly seated within base plate 28, the contact 70 will have the major portion of its contact tail 78 below the line 84 exemplary of the bottom surface 66 of the base plate 28. A portion of the contact tail 78 is then available for connection in the modes described above.

Figure 14:
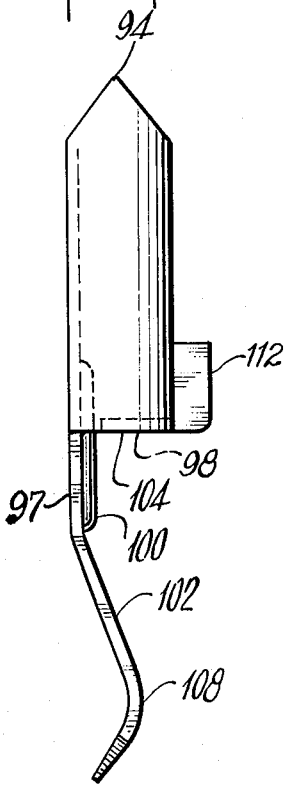
FIG. 14 is a side elevational view of the contact of FIG. 12.
Figure 15:
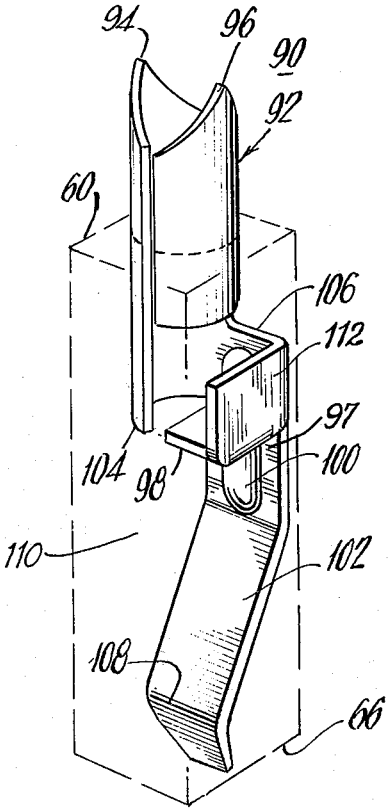
FIG. 15 is a fragmentary front perspective view of the contact of FIGS. 12 through 14 installed in a connector socket.

Turning now to FIGS. 12 through 15, there is shown another form of contact 90 constructed in accordance with the concepts of the invention. The contact 90 is intended for use in a configuration where it is desired to make contact between a flat conductor cable and the pins, for example, a DIP plug such as 52, shown in FIG. 4. The contact 90 has an upper cylindrical portion 92 defined by two upstanding arms 94 and 96 constructed in a manner described above with respect to FIGS. 5 and 9. A short transition region 97 extends from the cylindrical portion 92 to the tail portion 102. A strengthening rib 100 is positioned partly within the transition area 97 and partly within the contact tail 102. However, unlike the previous contacts 32 and 70, the entire intermediate portion 97, as well as the contact tail portion 102, lie within the body of the base plate of a connector. For example, the line 60 indicating the top surface of a base plate 28 of FIG. 3 extends through the cylindrical upper portion 92 whereas the line 66 indicating the bottom surface of a base plate such as 28 of FIG. 3 extends below the end of the contact tail portion 102. A shoulder 104 prevents undesired downward insertion of the contact 90, whereas a shoulder 106 prevents unwanted removal of the contact 90 from the socket 110 in which it is placed. (See FIG. 15). The contact tail 102 is bent, in a manner as best shown in FIG. 14, as at 108 so that a contact pin inserted within the socket 110 of the base plate may make good contact with the contact tail 102 of the contact 90. The curved contact tail portion 102 will also permit it to accommodate contacts of varying thickness while insuring a good electrical and mechanical union between the two. As is best seen in FIG. 15, the alignment of the contact tail 102, with the walls defining 110 can be appreciated. The curved portion as at 108 almost contacts the forward wall of the socket 110, whereas the free end of the contact tail 102 is adjacent the rearward wall. The width of the contact tail 102 is selected so as to extend substantially across the width of the entire socket 110. An additional arm, or positioning rib 112, is provided to assist in the positioning of the contact 90 and to improve its stability as the contact pins are being inserted into and removed from the socket 110 containing the contact 90. A stop 98 is coupled to the additional arm or positioning rib 112 and positioned at right angles to the plane thereof to limit the insertion of a contact pin into the contact 90.

While there have been shown and described and pointed out the fundamental novel features of the invention as applied to the preferred embodiments, it will be understood that various omissions and substitutions and changes of the form and details of the devices illustrated and in their operation may be made by those skilled in the art, without departing from the spirit of the invention.

The embodiments of the invention in which an exclusive property or privilege is claimed are defined as follows:

1. An electrical contact for piercing through the insulation of an insulated electrical conductor to make electrical contact with the conductor itself comprising: a longitudinally slotted, generally cylindrical body portion formed of a flat, resilient, conductive material having a top edge and a bottom edge, said longitudinal slot extending from said top edge to said bottom edge, the edges of said body portion defining said longitudinal slot being spaced apart to bite into the insulation of said conductor causing said longitudinal slot defining edges to move apart further and maintain a continuous contact therewith due to the attempt of the resilient material to recover its original configuration and provide strain relief for an insulated conductor forced into said contact; a further slot formed in said body portion directly opposite said longitudinal slot and extending from said top edge of said body portion towards said bottom edge of said body portion and terminating intermediate said top and bottom edges of said body portion, said further slot proportioned to cut through the insulation about said insulated conductor and engage the conductor to made a good electrical contact therewith when an insulated conductor is forced into said further slot, the entry of an insulated conductor into said further slot forcing the edges of said body portion defining said further slot to separate further, the resiliency of said material attempting to axially return said body portion to its original configuration to maintain continuous engagement between said edges defining said further slot and the conductor of the insulated conductor placed therein; the arcuate segments formed by said longitudinal slot and said further slot providing first and second arms terminating in sharp points at said top edge of said body portion, and having shoulder portions sloping from said point to each side of said first and second arms to guide an insulated electrical conductor into said longitudinal slot and said further slot; and a tail portion coupled to said body portion bottom edge to permit said contact to be coupled to a further electrical terminal point.

2. An electrical contact as defined in claim 1, wherein said tail portion is a flat, generally rectangular member having a strengthening rib thereon and dimensioned for receipt in a female socket of a dual-in-line socket connector.

3. An electrical contact as defined in claim 1, wherein said tail portion is a flat, generally rectangular member having sharp regular corners to bite into the metal of conductors wrapped about said tail portion.

4. An electrical contact as defined in claim 1, wherein said tail portion is formed in an undulating format whereby good electrical and mechanical contact can be made with a post-type contact brought into contact with said tail portion.

5. An electrical contact as defined in claim 1 wherein said body portion is circular.

6. An electrical contact as defined in claim 1 wherein a plane extending through said longitudinal slot and said further slot intersects at right angles a plane extending through said sharp points of said first and second arms.

7. An electrical contact as defined in claim 1, wherein said further slot extends in said body portion adjacent said tail portion and said longitudinal slot extends in said body portion remote from said tail portion.

8. An electrical contact as defined in claim 1, wherein said longitudinal slot extends in said body portion adjacent said tail portion and said further slot extends in said body portion remote from said tail portion.

9. An electrical contact as defined in claim 1, further comprising a transition region between said bottom edge of said body portion and said tail portion; at least one dimple formed in said transition region to prevent the undesired removal of said contact from a base member into which said contact is placed.

10. An electrical contact as defined in claim 9, wherein said transition region is offset from said body portion to provide a shoulder to further prevent the undesired removal of said contact from a base member into which said contact is placed.

11. An electrical contact as defined in claim 9, wherein said contact further comprises an additional arm coupled to said transition region and extending in a plane normal to the plane of said transition region to aid in the positioning of said contact in a base member into which said contact is placed.

12. An electrical contact as defined in claim 11 wherein said contact further comprises a stop member coupled to said additional arm in a plane normal to the planes of said additional arm and said transition region to limit the insertion of a post of said further electrical terminal point into said contact.

* * * * *